US005434351A

United States Patent [19]

Iwai et al.

[11] Patent Number: 5,434,351

[45] Date of Patent: Jul. 18, 1995

[54] DEVELOPING DEVICE HAVING DEVELOPING CYLINDER WITH WEAK MAGNETIC POLE AND ADJACENT STRONG MAGNETIC POLES

[75] Inventors: Masaharu Iwai; Yasushi Kakehashi, both of Mooka, Japan

[73] Assignee: Kanegafuchi Kagaku Kogyo Kabushiki Kaisha, Osaka, Japan

[21] Appl. No.: 186,882

[22] Filed: Jan. 26, 1994

Related U.S. Application Data

[63] Continuation of Ser. No. 942,189, Sep. 9, 1992, abandoned.

[30] Foreign Application Priority Data

Sep. 9, 1991 [JP] Japan ..... 3-081750 U
May 20, 1992 [JP] Japan ..... 4-040657 U

[51] Int. Cl.[6] ..... G03G 15/09
[52] U.S. Cl. ..... 118/658; 355/251
[58] Field of Search ..... 355/251, 253; 118/656, 118/657, 658

[56] References Cited

U.S. PATENT DOCUMENTS 3,988,816 11/1976 Tada ..... 118/658 X
4,166,263 8/1979 Harada et al. ..... 118/658 X
4,331,100 5/1982 Mochizuki et al. ..... 118/657
4,354,454 10/1982 Nishikawa ..... 118/658
4,525,056 6/1985 Itaya et al. ..... 118/658 X
4,825,241 5/1989 Saijo et al. .
4,851,872 7/1989 Murasaki et al. ..... 355/253
4,911,100 3/1990 Yamashita .
4,940,014 7/1990 Saijo et al. ..... 118/658
4,959,692 9/1990 Hayashi et al. ..... 355/253

FOREIGN PATENT DOCUMENTS 352102 1/1990 European Pat. Off. .
0132478 5/1990 Japan ..... 355/251

*Primary Examiner*—Robert Beatty
*Attorney, Agent, or Firm*—Armstrong, Westerman, Hattori, McLeland & Naughton

[57] ABSTRACT

A developing cylinder used in an electrophotographic developing device is improved in the efficiency of separation of a developer on its surface. A magnetic working force functioning to separate the developer from a sleeve surface is designed on the basis of a magnetic attraction force which results from a vector composite force consisting of a radial magnetic flux density and a tangential magnetic flux density on the sleeve surface and actually controls the behavior of the developer. The magnetic working force acting on a separation zone of weak magnetic flux density is made to act as a magnetic repulsion force functioning to separate the developer from the sleeve surface. The magnetic working force acting on a given area inclusive of a spot proximate to a photoconductor in a development zone is made to act as the magnetic repulsion force functioning to separate the developer from the sleeve surface. A magnet having a weak magnetic flux density pole is disposed in a developing zone and two strong magnetic flux density poles are disposed adjacent the weak magnetic flux density pole.

3 Claims, 10 Drawing Sheets

DEVELOPING DEVICE HAVING DEVELOPING CYLINDER WITH WEAK MAGNETIC POLE AND ADJACENT STRONG MAGNETIC POLES

This application is a continuation of application Ser. No. 07/942,189 filed Sep. 9, 1992, now abandoned.

BACKGROUND OF THE INVENTION

1. Field of the Invention

This invention relates to a developing cylinder which is used in an electrophotographic developing machine assembled in a copying machine, facsimile equipment, laser printer, etc.

It is an object of the present invention to provide a developing cylinder whose magnetic poles effectively separate a developer from the surface of a sleeve in a separation zone in which the developer is collected into a toner box or in a development zone in which the developer is delivered to a photoconductor.

It is another object of the present invention to provide a developing cylinder whose developer separation efficiency in a separation zone is enhanced so that the mixing ratio of carrier and toner and the quantity of electrification of a developer can be maintained constant.

It is still another object of the present invention to provide a developing cylinder whose developing magnetic pole (for delivering a developer from the surface of a sleeve onto the surface of a photoconductor) is improved in magnetic property so that scavenging can be prevented from appearing on a developed image and the quality/density of the image can be enhanced.

2. Description of the Prior Art

An electrophotographic developing machine is assembled in a copying machine, facsimile equipment, laser printer, etc. As shown in FIG. 14, the developing machine is composed fundamentally of a developing cylinder 100, a doctor blade 3, photoconductor 200 and a developer box 4.

The developing cylinder 100 is shown in FIG. 15 in greater detail. A magnet roll 1 is made by passing a metallic shaft through a hollow portion of a cylindrical magnet made of a resin-bonded magnet or sintered magnet or by attaching short rods to both ends of a pillar magnet, this magnet roll 1 being supported inside a cylindrical sleeve 2 in noncontact condition. The doctor blade 3 is disposed in confronting relation to the sleeve 2 of the developing cylinder 100 as to cover the whole width of the sleeve 2 such that a doctor-sleeve gap is left between them.

Since the developing cylinder 100 is put into operation by rotating the sleeve 2 relative to the magnet roll 1, when the sleeve 2 is rotated about the magnet roll 1, the developer held in the box 4 is picked up onto the surface of the sleeve 2 by magnetic force. The developer put on the surface of the sleeve 2 passes through the gap between the sleeve 2 and the doctor blade 3, by which the quantity of developer attached is controlled, and is then transferred onto the photoconductor with an electro static image imprinted thereon.

The developer used in the electrophotographic developing machine is divided into two types: the one-component developer made of synthetic resin particles scatteringly combined with magnetic powder, and the two-component developer made by bonding toner particles made of resin and adhesive to carrier particles (larger in size than the former) made of iron powder.

Where the two-component developer (made by mixing the carrier and the toner) is used, only the electrified toner transfers onto the surface of the photoconductor 200, with the result that the developer remaining on the surface of the sleeve 2 after toner transfer includes the carrier in a larger mixing ratio; therefore, the developer having such a deviated mixing ratio must be collected into the developer box 4 or removed from the surface of the sleeve 2. For this purpose, a magnetic pole for developer separation is provided in the developing cylinder 100.

FIG. 16 shows magnetic poles on the surface of a conventional magnet roll and a distribution of magnetic flux density. Magnetic poles N1 and N2 are of the N-pole type, and S1, S2 and S3 are of the S-pole type. Specifically, a plurality of magnetic poles are arranged in the circumferential direction of the magnet roll 1, each extending in the axial direction. These magnetic poles function to pick up the developer, transfer, deliver to the photoconductor, and collect into the developer box. A separation zone designated by A in FIG. 16 is provided for the purpose of releasing or separating the developer before collecting it into the developer box.

In view of the purpose of developer separation, the magnetic flux density in the separation zone A should be made as weak as possible. Although this requirement is fulfilled by providing a zone of no magnetic field, it is practically impossible to provide such a zone of no magnetic field. Therefore, in the prior art, the separation zone is defined by providing a magnetic pole NO of weak magnetic flux density which is opposite in polarity to the adjacent magnetic poles S2 and S3.

Although having a weak magnetic flux density, the conventional separation zone sometimes attains insufficient separation. The present inventor studied the causes of such defective separation and found that the concept of "distribution of magnetic flux density" traditionally used is not fit to the designing of the magnet roll. Specifically, distribution of magnetic flux density shows only the magnetic flux density in the radial direction on the surface of the magnet roll, and the direction of magnetization (inside the magnet roll) of each magnetic pole is not always in accord with the radial direction (normal direction) of the magnet roll as shown in FIG. 17 in vector notation. Thus, the conclusion is that the distribution of magnetic flux density showing the radial magnetic flux density on the surface of the magnet roll can not be considered equivalent to an actual magnetic working force on the surface of the magnet roll.

That is, the conventional procedure of designing the magnet roll is wrong which is based on the idea of distribution of magnetic flux density or achieved by evaluating the magnetic working force of each magnetic pole of the magnet roll using only the radial magnetic flux density on the surface of the magnet roll.

Although the conclusion that the conventional designing procedure is wrong is deduced from the designing of the separation zone as described above, it can also be applied to the designing of other magnetic poles for separating the developer from the surface of the sleeve and to the designing of a development zone in which the developer is delivered to the photoconductor.

BRIEF DESCRIPTION OF THE INVENTION

The present invention has been devised on the basis of the foregoing consideration. That is, instead of the concept of distribution of magnetic flux density, the present invention has introduced a new concept of magnetic working force which actually defines the action of attracting a developer toward the surface of a sleeve and the action of separating the developer from the sleeve surface. Accordingly, the magnetic pattern of a magnetic pole for separating the developer from the sleeve surface is designed on the basis of the concept of magnetic working force.

In a first aspect of the present invention, the force of actually attracting or repelling the developer on the surface of a magnet roll is referred to as "magnetic attraction force", and the magnetic pattern of a magnetic pole for attaining separation on the surface of a developing cylinder is designed on the basis of the concept of "magnetic attraction force". It has also been found from further studies that the "magnetic attraction force" results from a vector composite force consisting of a radial magnetic flux density and a tangential magnetic flux density on the sleeve surface.

The "magnetic attraction force", which is a vector composite force, has a direction. If the force goes from outside toward the sleeve surface, it is called the magnetic attraction force with a plus direction, on the other hand the force toward outside from the sleeve surface is called the magnetic attraction force with a minus direction. The magnetic attraction force with a plus direction functions to attract a developer toward the surface of a sleeve, and the magnetic attraction force with a minus direction, working as a magnetic repulsion force, functions to separate the developer from the sleeve surface.

In a second aspect of the present invention, the foregoing designing idea is applied to the designing of the magnetic pattern of a separation zone to provide a developing cylinder whose efficiency of separation of a developer in the separation zone is much enhanced.

In a third aspect of the present invention, the foregoing designing idea is applied to the designing of the magnetic pattern of a development zone to provide a developing cylinder whose action of delivering a developer is improved so that scavenging can be prevented from appearing on a developed image and the quality/-density of the image can be enhanced.

Specifically, in the first aspect of the present invention, the magnetic working force functioning to separate the developer from the sleeve surface is designed on the basis of the "magnetic attraction force" which results from the vector composite force consisting of the radial magnetic flux density and the tangential magnetic flux density on the sleeve surface and actually controls the behavior of the developer.

In the second aspect of the present invention, the magnetic working force acting on the separation zone of weak magnetic flux density in which the developer remaining on the sleeve surface is collected into a toner box is made to act as a magnetic repulsion force functioning to separate the developer from the sleeve surface.

More specifically, it is preferable that a magnetic pole of weak magnetic flux density for defining the separation zone be made identical in polarity with magnetic poles of strong magnetic flux density provided adjacent to the weak magnetic pole on the upstream side and downstream side in the travel direction of the developer.

FIG. 18 shows the "magnetic attraction force" around a developing magnetic pole 5 of a conventional developing cylinder which was measured on the basis of the concept of "magnetic attraction force" introduced in the present invention, in which "MF" is a distribution or pattern of magnetic attraction force. The developing magnetic pole 5 functions to transfer the developer magnetically attached to the surface of the sleeve 2 of the developing cylinder 100 up to a position facing opposite the photoconductor 200 without any loss and then deliver the developer onto the surface of the photoconductor 200.

As shown in the drawing, the magnetic attraction force pattern MF around the conventional developing magnetic pole 5 has a single peak value (maximal value) at the center, and the direction of the magnetic attraction force is directed to the sleeve surface over the whole face of the developing magnetic pole 5 as illustrated by the arrows. Generally, design is made such that the developer is delivered to the photoconductor 200 at or around the peak position (maximal position) of the magnetic attraction force.

FIG. 19 shows a condition in which a two-component developer is delivered from the surface of the sleeve 2 onto the surface of the photoconductor 200 by the developing magnetic pole 5 having such a magnetic attraction force pattern. Specifically, the carrier of the two-component developer is changed into the form of chains or ropes by the magnetic attraction force of the developing magnetic pole 5 such that a number of spikes 7 are formed on the surface of the sleeve 2 in erect condition or so-called magnetic brushes are formed between the photoconductor 200 and the sleeve 2. By bringing the distal ends of the spikes 7 into contact:with the surface of the photoconductor 200 electrified, the toner 8 attached around the carrier 6 is delivered onto the surface of the photoconductor 200 electrified by virtue of a combined force of static electricity and magnetic force, whereby development is attained.

In the case of a one-component developer, the toner having magnetism is changed into the form of chains such that spikes are formed in erect condition. By bringing the tips of the spikes into contact with or proximity to the photoconductor, the toner jumps toward the photoconductor with the spike tips going ahead of other portions, whereby the toner is delivered.

In the developing cylinder as described above, the delivery of the developer to the photoconductor 200 is attained mainly by the spikes erecting at or around the peak position (maximal position) of the magnetic attraction force pattern MF. Since the spikes stand at or around the peak position of the magnetic attraction force, in the case of the two-component developer, the chain coupling force between the carrier 6 and the toner 8 in spike form is very strong. Therefore, the toner 8 hardly separates from the spike tips, the delivery of the toner 8 to the photoconductor 200 is not attained as expected, and thus, the quality/density of a developed image is enhanced little. Further, since the spike tips are tight because of a strong coupling force, they scrape off the layer of the toner delivered onto the surface of the photoconductor 200, with the result that scavenging appears on the developed image.

Although the toner (having magnetism) itself forms the spikes, the one-component developer suffers the same drawbacks as those of the two-component developer.

To overcome the foregoing drawbacks in the development zone, in the third aspect of the present invention, the magnetic attraction force pattern of the developing magnetic pole is improved so that the delivery of the developer from the sleeve surface onto the photoconductor surface can be smoothly attained, whereby the developing cylinder thus produced prevents scavenging from appearing on the developed image and enhances the quality/density of the image.

In the developing cylinder according to the third aspect of the present invention which is free of the drawbacks in the development zone, the magnetic working force acting on a given area inclusive of a spot proximate to the photoconductor in the development zone in which the developer is delivered from the sleeve surface to the photoconductor is made to act as a magnetic repulsion force functioning to separate the developer from the sleeve surface.

It is preferable that in the distribution of radial magnetic flux density caused by the magnetic pole for defining the development zone, the minimal value of the magnetic flux density of the spot proximate to the photoconductor in the development zone be set smaller than the maximal value of the magnetic flux density of the magnetic pole provided adjacent to the spot on the upstream side in the travel direction of the developer by at least 20% of the maximal value.

It is also preferable that in the development zone, the magnetic working force acting on the downstream side in the travel direction of the developer in adjacent relation to the spot giving the magnetic repulsion force is made to act as the "magnetic attraction force" functioning to attract the developer toward the sleeve.

The operation of the developing cylinders according to the second and third aspects embodying the first aspect of the present invention will be described.

In the developing cylinder according to the second aspect of the present invention, the polarity of the separation zone is identical with that of the adjacent magnetic pole; therefore, the repulsion force acts on the developer having come past the adjacent magnetic pole up to the separation zone in response to the rotation of the sleeve, so that the developer is readily separated from the sleeve surface.

The reason why the efficiency of separation where the polarity of the separation zone is made identical with that of the adjacent magnetic pole is superior to that where the two polarities are opposite will be considered.

FIG. 1 schematically shows the behavior of a developer in a developing cylinder according to the present invention, including a magnet roll 1 in which a magnetic pole SO of the same polarity as that of adjacent magnetic poles S2 and S3 is provided in a separation zone A. FIG. 2 schematically shows the behavior of a developer in a conventional developing cylinder including a magnet roll 1 in which a magnetic pole NO of the polarity opposite to that of adjacent magnetic poles S2 and S3 is provided in a separation zone A. In these drawings, developer particles 300 are magnetically attached to the surface of a sleeve 2, so that in response to the rotation of the sleeve 2, the developer particles 300 move along the circumference of the magnet roll in the direction of the arrow. Since the magnetic flux density of the magnetic poles S2 and S3 are strong and the magnetic flux density of the separation zone A is much weaker than the former, each developer particle 300 in the area between the magnetic poles S2 and S3 is polarized such that its one end close to the magnetic pole S2 or S3 exhibits the N pole and its other end exhibits the S pole. In this way, irrespective of the polarity of the magnetic pole provided in the separation zone A, the one end of each developer particle 300 moving through the separation zone A that is close to the magnetic pole defining the separation zone A exhibits the S pole. That is, the one end of each developer particle 300 lying within the separation zone A that is close to the magnetic pole defining the separation zone A takes the same polarity as that of the magnetic pole provided adjacent to the separation zone.

Where the magnetic pole defining the separation zone A is made identical in polarity with the adjacent magnetic poles as shown in FIG. 1, the magnetic pole SO of the separation Zone A and the S-pole end of each developer particle 300 repel each other; therefore, the minus "magnetic attraction force" or the magnetic repulsion force acts on the developer particles 300, so that the developer particles 300 are readily separated.

The foregoing phenomenon will be described in a different manner. Where the magnetic pole defining the separation zone A is made identical in polarity with the adjacent magnetic poles, the radial magnetic flux-density of the separation zone is stronger at a point spaced slightly from the sleeve surface than at the sleeve surface; therefore, the "magnetic attraction force" resulting from a vector composite force consisting of a radial magnetic flux density and a tangential magnetic flux density acts outwardly of the sleeve surface (in a radially outward direction). Accordingly, the developer particles 300 lying on the sleeve surface are pulled toward the point spaced slightly from the sleeve surface or the repulsion force acts on the developer particles 300 as to separate them from the sleeve surface; therefore, the developer particles 300 are readily separated from the sleeve surface.

Although the reason why the radial magnetic flux density is stronger at the point spaced slightly from the sleeve surface than at the sleeve surface is unclear, the present inventor has confirmed using a magnetic Hall element that the radial magnetic flux density is stronger at the point spaced slightly from the sleeve surface in the radial direction than at the sleeve surface.

Contrarily, where the N magnetic pole is provided in the separation zone A as shown in FIG. 2, the magnetic pole NO of the separation zone h and the S-pole end of each developer particle 300 attract each other; therefore, because of a strong "magnetic attraction force" acting on the developer particles 300, the developer particles 300 are hardly separated.

The foregoing description would explain why the efficiency of separation where the magnetic pole of the separation zone is made identical in polarity with the adjacent magnetic poles is superior to that where the opposite polarities are employed. The first through third aspects of the present invention are based on the foregoing conclusion or phenomenon.

The operation of the developing cylinder according to the third aspect of the present invention will be described.

In the third aspect of the present invention, the magnetic working force acting on a given area inclusive of a spot proximate to the photoconductor in the development zone in which the developer is delivered from the sleeve surface to the photoconductor is made to act as the magnetic repulsion force functioning to separate the developer from the sleeve surface; therefore, the toner attached to the spikes erecting from the proximate spot toward the photoconductor surface readily separates from the spike tips, and the spike tips become loose or soft. Accordingly, the toner is readily delivered from the spike tips onto the photoconductor surface, and the toner delivered onto the photoconductor surface is never scraped off by the spike tips.

If the force of attracting the developer toward the sleeve is made to act on the downstream side (in the rotational direction of the sleeve) of the spot giving the repulsion magnetic field as caused by the developing magnetic pole, the developer excessively attached to the photoconductor surface is collected on the side of the developing cylinder.

DETAILED DESCRIPTION OF THE PREFERRED EMBODIMENTS

Embodiments will now be described with reference to the drawings.

Figure 1:
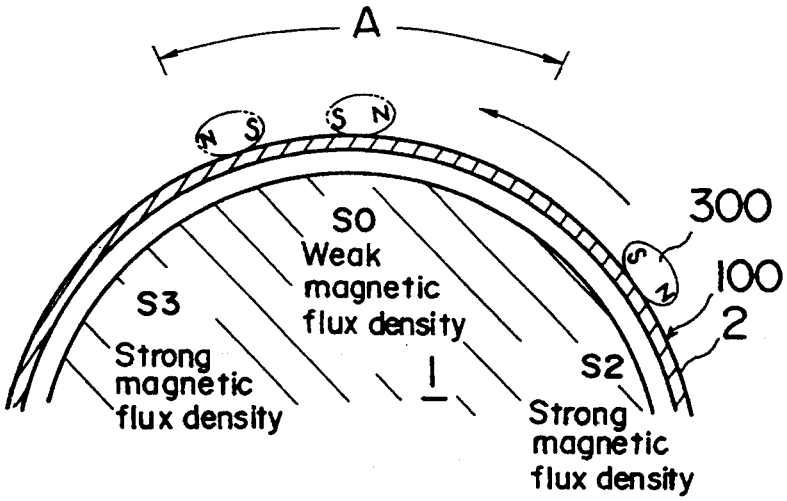
FIG. 1 is a diagram showing the behavior of a developer in the vicinity of a separation zone in case a magnetic pole of the same polarity, as that of adjacent magnetic poles is provided in the separation zone.
Figure 2:
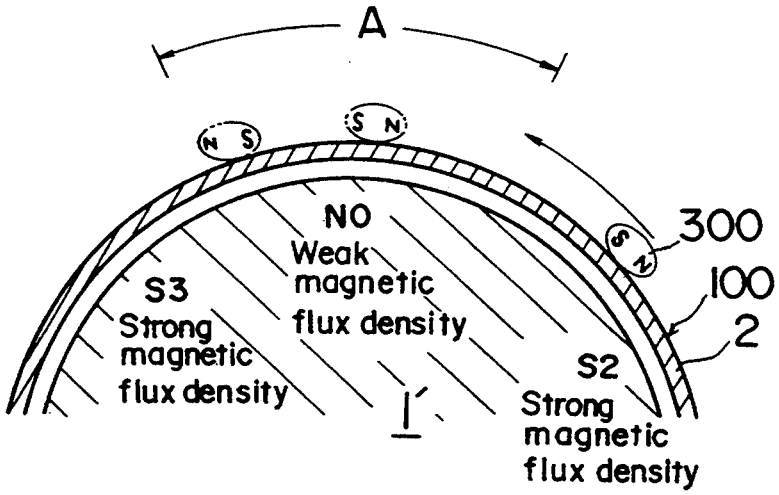
FIG. 2 is a diagram showing the behavior of a developer in the vicinity of a separation zone in case a magnetic pole of the polarity opposite to that of adjacent magnetic poles is provided in the separation zone.
Figure 3:
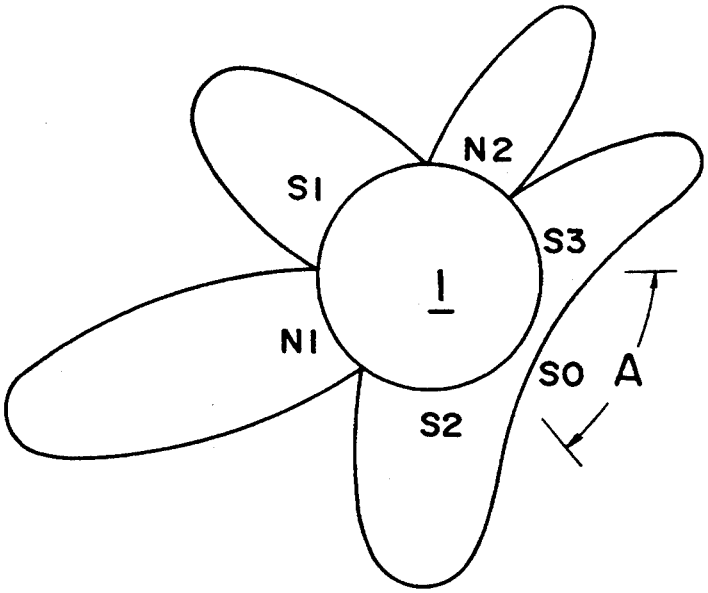
FIG. 3 is a diagram showing the surface magnetization and distribution of magnetic flux density of a magnet roll used in a developing cylinder according to the second aspect of the present invention.

FIG. 3 shows the arrangement of magnetic poles provided on the surface of a magnet roll used in a developing cylinder according to the second aspect of the present invention and the resulting distribution of magnetic flux density. The concept of distribution of magnetic flux density is traditionally employed in designing the magnetic pattern of the magnet roll. "SO" is a magnetic pole provided in a separation zone A, whose polarity is identical with that of adjacent magnetic poles S2 and S3. Since the gist of the present invention is to make a magnetic working force acting on the separation zone A act as a magnetic repulsion force, it is preferable that the magnetic pole of the separation zone be identical in polarity with the adjacent magnetic poles; therefore, where the adjacent magnetic poles are of the N-pole type, the magnetic pole provided in the separation zone A is to be of the N-pole type.

Figure 4:
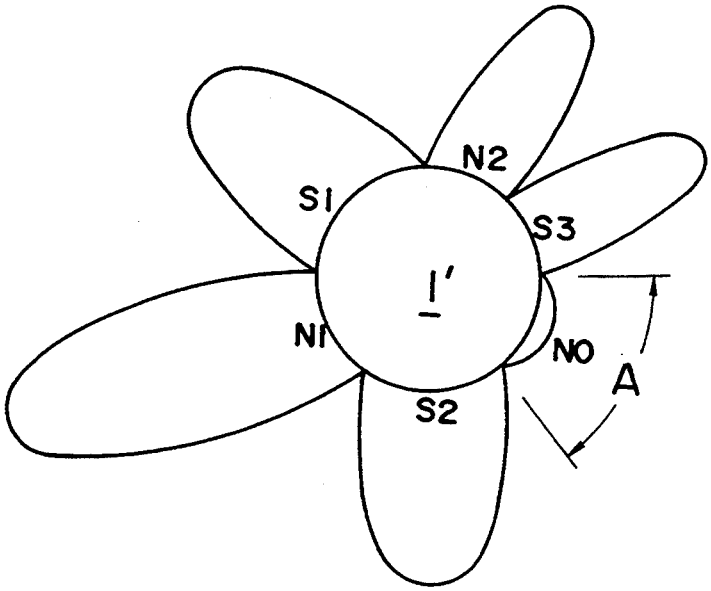
FIG. 4 is a diagram showing the surface magnetization and distribution of magnetic flux density of a conventional magnet roll.

To ascertain the efficiency of separation in the separation zone of the magnet roll used in the developing cylinder according to the present invention, the present inventor performed a comparison test on the magnet roll 1 shown in FIG. 3 and a conventional magnet roll 1' as shown in FIG. 4.

The conventional magnet roll 1' is identical in pole arrangement and distribution of magnetic flux density with the magnet roll 1 shown in FIG. 3 except for the magnetic pole of the separation zone A. That is, only tile polarity of the separation zone A differs between FIG. 3 and FIG. 4. In the comparison test, the magnetic attraction force in the separation zone A of each type of magnet roll was measured. The procedure of measurement will be described.

Figure 5:
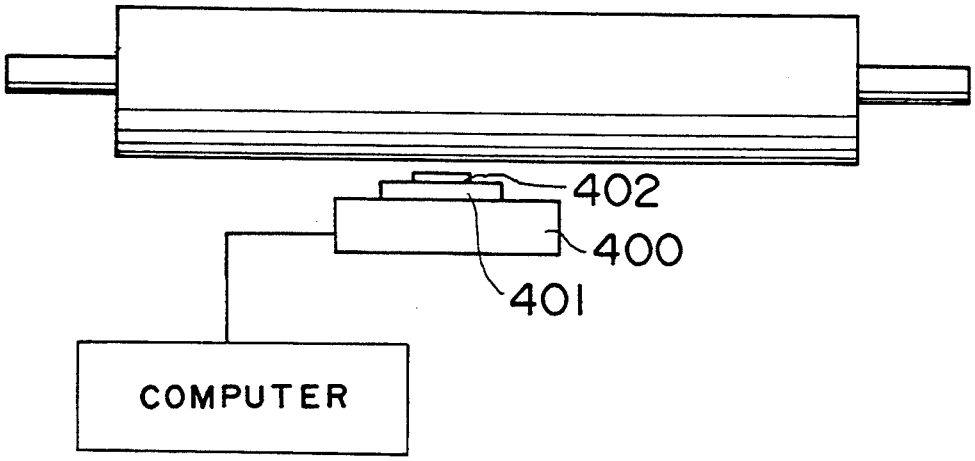
FIG. 5 is a diagram showing a test instrument used in measuring a magnetic attraction force.
Figure 6:
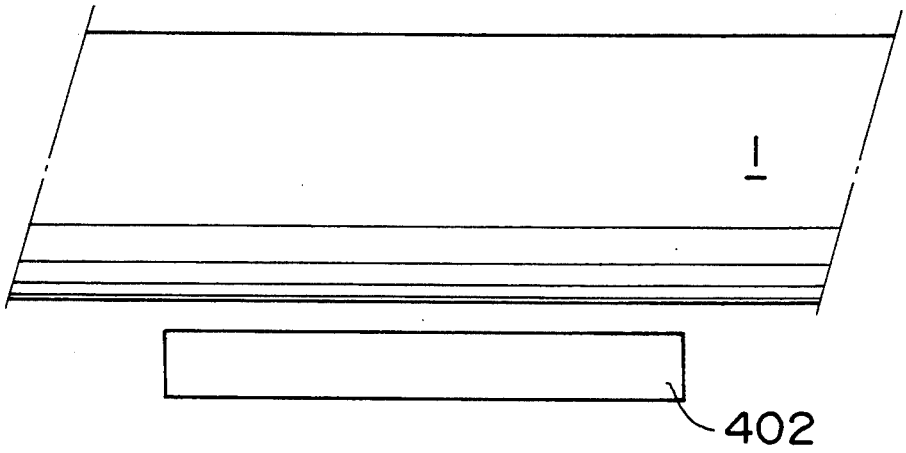
FIG. 6 is a fragmentary enlarged view of the test instrument shown in FIG. 5.

As shown in FIG. 5, an iron angular needle 402 of 1 mm×1 mm×35 mm in size as shown in FIG. 6 was put on a pan 401 of an electronic weigher 400, a magnet roll 1 to be examined was rotatably supported over the ang needle 402, and the clearance between the surface of the magnet roll 1 and the surface of the angular needle 402 was set to 0.2 mm (the distance between the surface of the magnet roll and the center of the angular needle to 0.7 mm). Then, while softly rotating the magnet roll 1, the weight of the angular needle 402 was observed to see how it changes in the separation zone A. Such weight observation was performed several times per magnet roll, and the results of measurement were processed by a computer to obtain a mean value. The following was revealed. In the conventional magnet roll 1' with an N-pole surface magnetic field of 70 gauss provided in the separation zone A, the weight of the angular needle decreased by 0.1 g in the separation zone A, this meaning that a magnetic attraction force of 0.1 g is acting in the separation zone A of the conventional magnet roll 1'. On the other hand, in the magnet roll (used in the developing cylinder according to the present invention) with an S-pole surface magnetic field of 85 gauss provided in the separation zone A, the weight of the angular needle increased by 0.1 g in the separation zone A, this meaning that a magnetic repulsion force of 0.1 g is acting in the separation zone A of the magnet roll 1. Further, when the surface magnetic field of the magnetic pole SO defining the separation zone A was set to 200 gauss, the weight of the angular needle increased by 0.15 g, this meaning that a magnetic repulsion force of 0.15 g is acting.

Subsequently, the quantity of separation was measured using an actual developer. For an N-pole surface magnetic field of 70 gauss provided in the separation zone A, 28g out of 100g of developer magnetically attached to the surface of a sleeve was released or separated, whereas for an S-pole surface magnetic field of 85 gauss provided in the separation zone A, 96 g out of 100 g was separated, the latter case proving that a satisfactory efficiency of separation can be secured.

The third aspect of the present invention will be described in greater detail, which is to apply the concept of "magnetic attraction force" introduced in the first aspect of the present invention to the designing of the magnetic pattern of a development zone.

Figure 7:
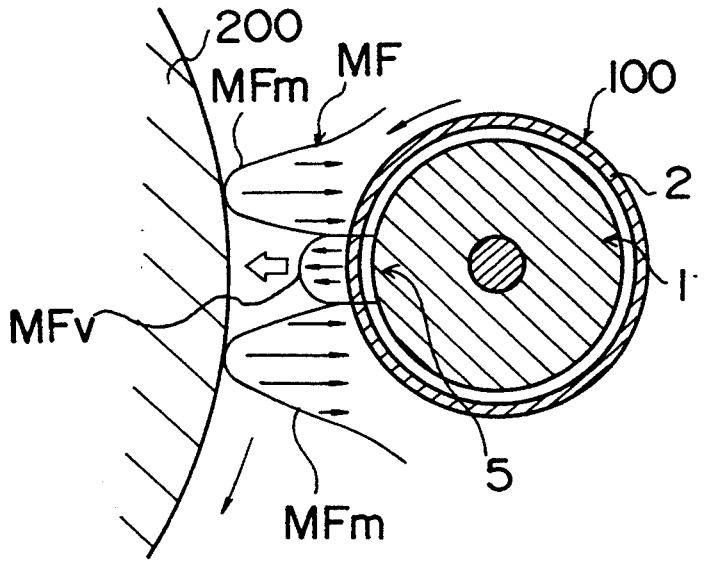
FIG. 7 is a diagram showing a distribution of magnetic attraction force (a pattern of magnetic attraction force) caused by a developing magnetic pole in a developing cylinder according to the third aspect of the present invention.

FIG. 7 shows a developing cylinder according to the third aspect of the present invention. "5" is a developing magnetic pole provided in confronting relation to a photoconductor 200, and a certain area centering on the developing magnetic pole 5 is referred to as a development zone. The curve MF shows a distribution of magnetic attraction force (a pattern of magnetic attraction force) caused by the developing magnetic pole 5, and the associated arrows show the directions of attraction. The distribution curve of magnetic attraction force shows the force actually acting on the developer moving on the sleeve surface, this feature being suggested in the first aspect of the present invention. As shown in the drawing, the distribution curve MF of magnetic attraction force caused by the developing magnetic pole 5 includes a trough portion MFv of magnetic repulsion force at the center of the pattern MF of magnetic attraction force caused by the developing magnetic pole 5. This trough portion MFv of magnetic repulsion force is provided in proximate confronting relation to the photoconductor 200, and the peak value (maximal value) of the trough portion MFv is set smaller than the peak value (maximal value) of the magnetic attraction force of crest portions MFm provided in adjacent relation on the upstream side and downstream side of the trough portion MFv. In this way, by making the magnetic repulsion force or the force illustrated by the arrow and directed outwardly of the sleeve surface act on a given area inclusive of a spot proximate to the photoconductor in the development zone, the efficiency of separation of the developer in the proximate spot can be enhanced.

Figure 8:
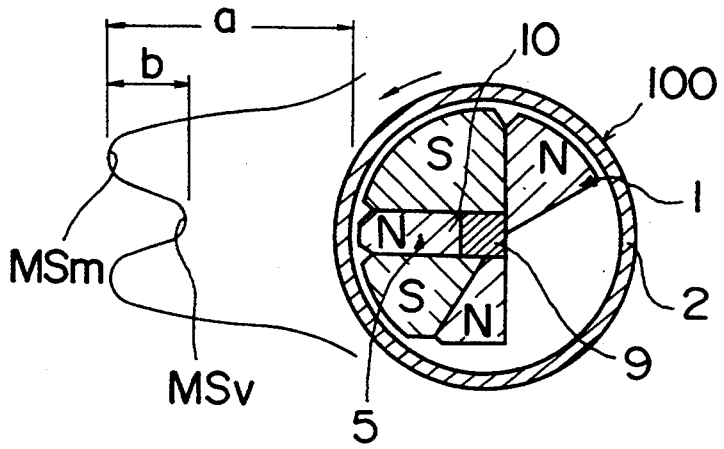
FIG. 8 is a diagram showing a distribution of radial magnetic fluxe density (a distribution of magnetic flux density) caused by the developing magnetic pole in the developing cylinder according to the third aspect of the present invention.

Although several ways will be considered to provide the trough portion MFv of magnetic repulsion force at substantially the center of the distribution curve MF of magnetic attraction force, since the magnetic attraction force is a vector composite force consisting of radial magnetic flux density and a tangential magnetic flux density, the trough portion MFv can be provided by regulating the intensity of the radial magnetic flux density (the distribution of magnetic flux density). For example, FIG. 8 shows a magnet roll 1 made by bonding magnet pieces of desired magnetic intensity around an angular shaft 9 and the resulting distribution of radial magnetic flux density. In this case, a portion of the surface of a magnet piece 10 defining the developing magnetic pole 5 is demagnetized such that the radial magnetic flux density MS at a central portion of the surface of the developing magnetic pole becomes weaker than at other portions, thereby implementing the magnetic repulsion force. The magnetic pole of the surface of the magnet piece 10 is of the N-pole type and the two magnetic poles adjacent thereto are of the S-pole type. The trough portion MSv of the radial magnetic flux density of the developing magnetic pole is identical in polarity with the crest portion MSm of the radial magnetic flux density of said developing magnetic pole, both of them being of the S-pole type. Although the trough portion MSv of the radial magnetic flux density of the developing magnetic pole and the crest portion MSm of the radial magnetic flux density of the developing magnetic pole shown in the drawing are of the S-pole type, these portions may be of the N-pole type. The description previously given in connection with the first aspect of the present invention applies to the reason why the magnetic repulsion force is exerted by making the trough portion MSv of the radial magnetic flux density of the developing magnetic pole and the crest portion MSm of the radial magnetic flux density of the developing magnetic pole identical in polarity and making the radial magnetic flux density MSv weaker than the radial magnetic flux density MSm of the adjacent magnetic poles.

Although the magnet roll 1 shown in FIG. 8 is made by bonding magnet pieces together, it can be modified. For example, as shown in FIG. 9, the magnet roll may be made of an integrated resin-bonded magnet whose surface has a number of magnetic poles provided by magnetization.

Figure 10:
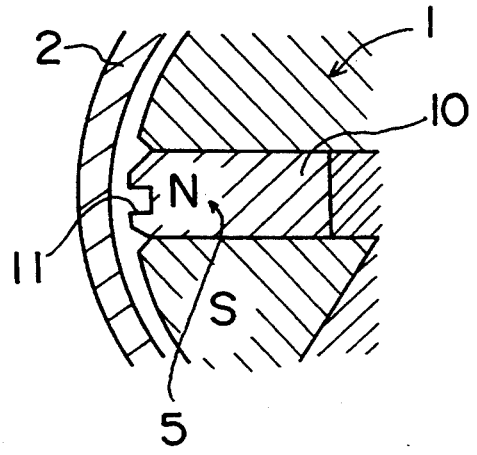
FIG. 10 is a diagram showing a multi-piece magnet roll (made by bonding a plurality of magnet pieces together) used in the developing cylinder according to the third aspect of the present invention, which has a groove formed in the surface of a magnet piece defining the developing magnetic pole.
Figure 11:
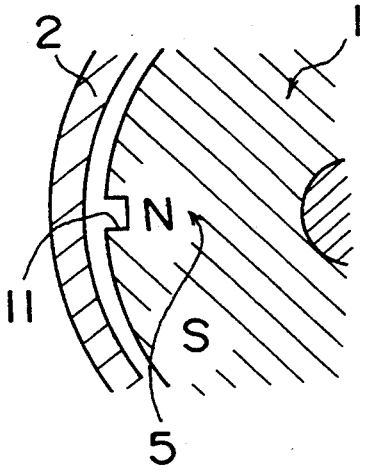
FIG. 11 is a diagram showing the integrated resin-bonded multi-pole magnet roll used in the developing cylinder according to the third aspect of the present invention, which has a groove formed in the surface of a magnet portion defining the developing magnetic pole.
Figure 12:
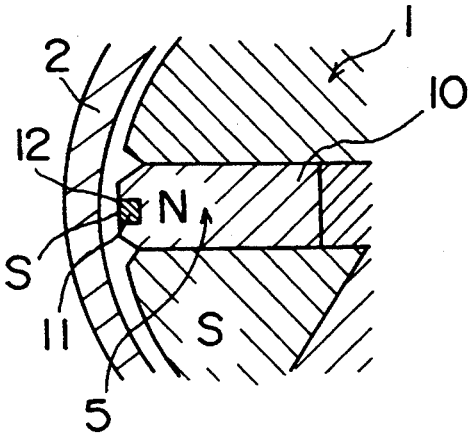
FIG. 12 is a diagram showing the multi-piece magnet roll used in the developing cylinder according to the third aspect of the present invention, which has a magnet piece of the opposite polarity embedded in the groove formed in the surface of the magnet piece defining the developing magnetic pole.
Figure 13:
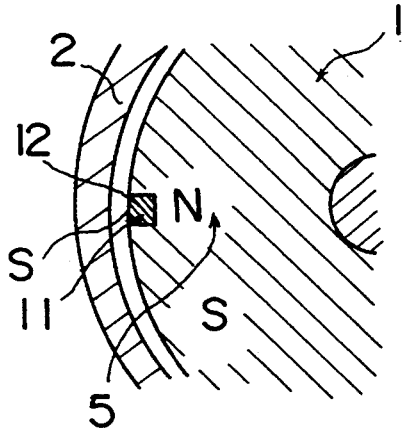
FIG. 13 is a diagram showing the integrated resin-bonded multi-pole magnet roll used in the developing cylinder according to the third aspect of the present invention, which has a magnet piece of the opposite polarity embedded in the groove formed in the surface of the magnet portion defining the developing magnetic pole.
Figure 14:
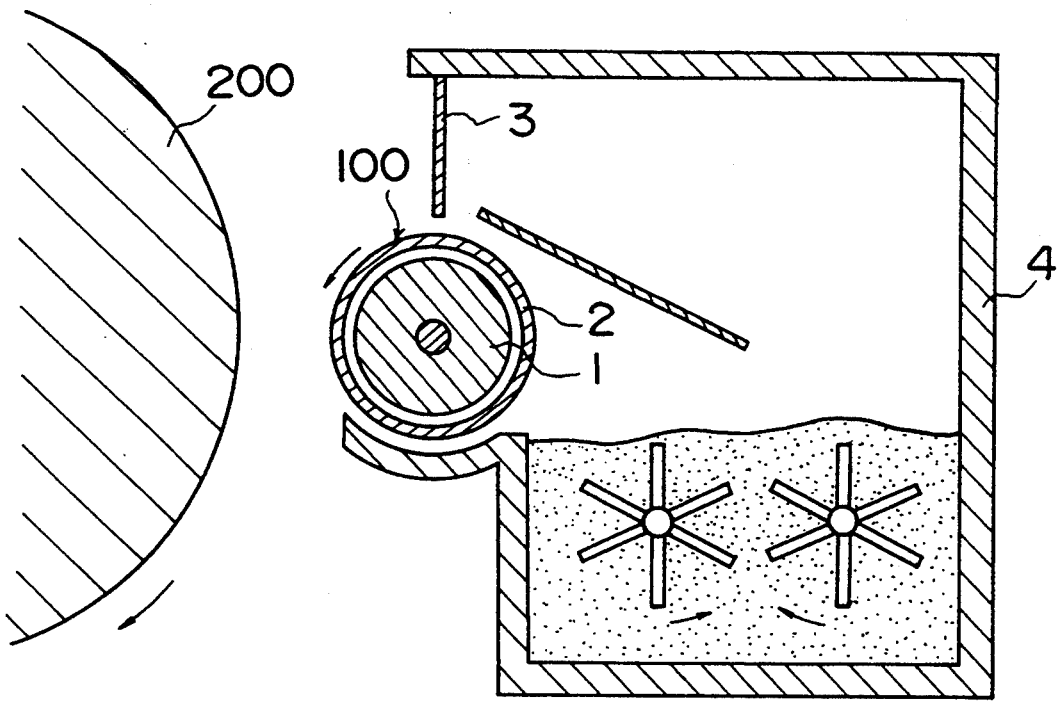
FIG. 14 is a diagram schematically showing a developing machine composed of a developing cylinder, a photoconductor and a developer box.
Figure 15:
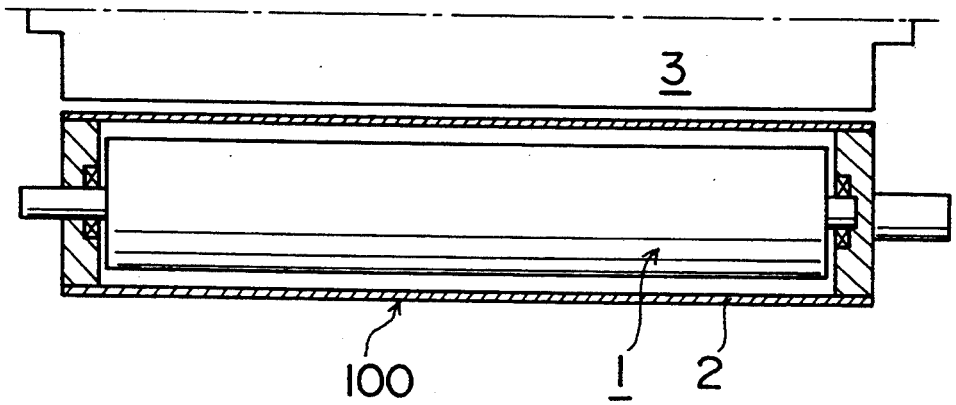
FIG. 15 is an axial sectional view of the developing cylinder.
Figure 16:
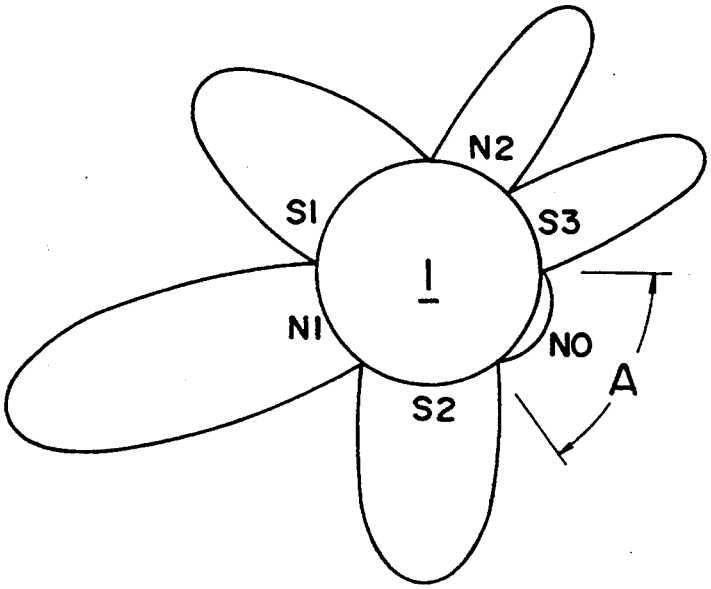
FIG. 16 is a diagram showing the surface magnetization and distribution of magnetic flux density of a conventional magnet roll.
Figure 17:
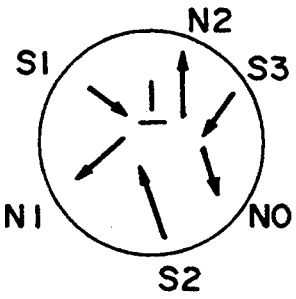
FIG. 17 is a diagram showing the direction of magnetization inside a conventional magnet roll.
Figure 18:
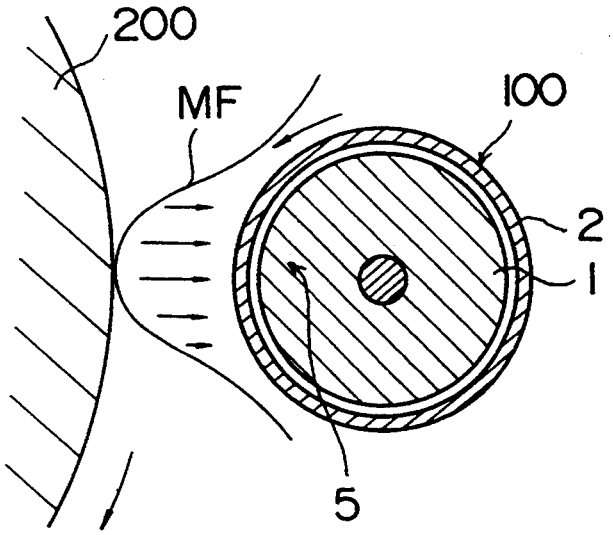
FIG. 18 is a diagram showing a distribution of magnetic attraction force ( a pattern of magnetic attraction force) caused by a developing magnetic pole of a conventional magnet roll.
Figure 19:
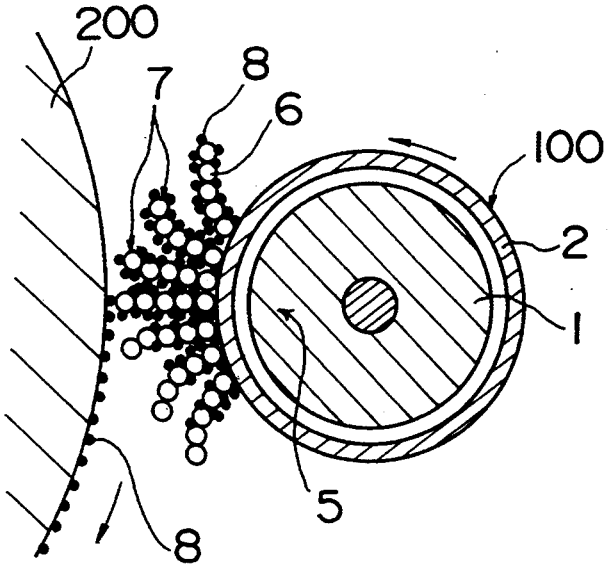
FIG. 19 is a diagram showing the delivery of a developer from the surface of a sleeve onto the surface of a photoconductor in a conventional developing cylinder.

Other than demagnetization as described above, the way to provide the trough portion MFv of magnetic repulsion force at substantially the center of the magnetic attraction force pattern MF can be attained by forming an axial groove 11 at the center of the surface of the developing magnetic pole 5 to decrease the cubage of the magnet as shown in FIGS. 10 and 11, or by embedding or fitting a magnet piece 12 of the opposite magnetic polarity in the groove 11 as shown in FIGS. 12 and 13.

Figure 9:
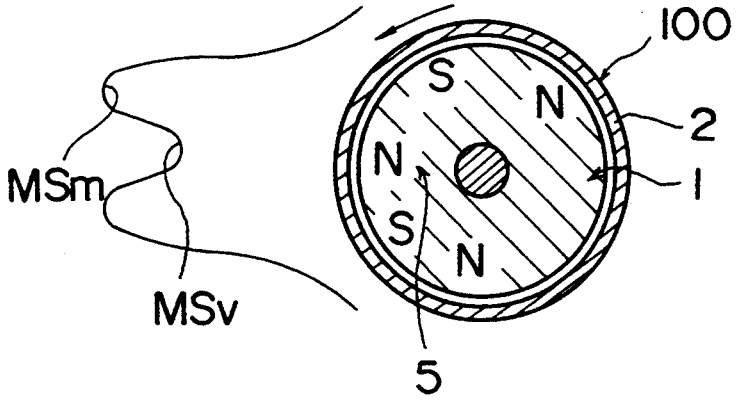
FIG. 9 is a diagram showing a multi-pole magnet roll (magnetized as to have a plurality of magnetic poles) used in the developing cylinder according to the third aspect of the present invention, which is made of an integrated resin-bonded magnet.

In the foregoing embodiments, the radial magnetic flux density MSv of the trough portion of the developing magnetic pole 5 is made weaker than the radial magnetic flux density MSm of the crest portion as shown in FIGS. 8 and 9 by demagnetization, forming the groove, or attaching the magnet of the opposite magnetic polarity, with the result that the trough portion MFv of relatively weaker magnetic force is provided in a central portion of the magnetic attraction force pattern MF of the development zone as shown in FIG. 7; consequently, the force of separating from the sleeve surface is imposed on the developer having come past the adjacent magnetic pole.

In connection with the intensity of the radial magnetic flux density MFv of the trough portion, it has been found that when the difference b between the minimal value of the radial magnetic flux density MSv of the trough portion and the maximal value of the radial magnetic flux density MSm of the crest portion adjacent to the trough portion is set to 20% or more of the maximal value a of the magnetic flux density of the crest portion on the upstream side as shown in FIG. 8, the efficiency of delivery of the developer from the developing magnetic pole 5 to the photoconductor 200 is much enhanced.

Since the embodiments are made such that the trough portion of weak magnetic flux density is provided at substantially the center of the magnetic attraction force pattern MF created by the developing magnetic pole 5, a spot in which the force of attracting toward the sleeve acts on the developer is defined on the downstream side of the trough portion. Therefore, since the magnetic attraction force directed to the sleeve is made to act on the downstream side of the trough portion of magnetic repulsion force, even when the magnetic toner or the magnetic carrier is excessively attached to the surface of the photoconductor 200, it can be adequately collected on the side of the developing cylinder; accordingly, a so-called toner background fog or carrier background fog on the developed image (due to excessive attaching of the developer) can be prevented. It is desirable to determine, in consideration of the foregoing, the peak value and position of the magnetic attraction force of the spot on the downstream side in which the magnetic attraction force directed to the sleeve is exerted. Usually, the peak position of the magnetic attraction force is set as to take an angle of 3° to 20 ° to the center on the downstream side.

As described above, in the developing cylinder according to the present invention, the magnetic pattern of the magnetic poles for separation purposes on the surface of the developing cylinder is designed on the basis of the concept of "magnetic attraction force" (introduced in the first aspect of the present invention) actually controlling the behavior of the developer on the surface of the magnet roll.

According to the second aspect of the present invention in which the magnetic pattern of the separation zone is designed on the basis of the concept of "magnetic attraction force", the efficiency of separation of the developer in the separation zone can be made very superior as compared with the conventional developing cylinder. Therefore, since the developer remaining after transfer to the photoconductor whose mixing balance of toner and carrier is deviated from a normal level can be discarded or collected effectively, the balance of toner and carrier of the unused developer magnetically attached to the sleeve surface can always be maintained in good condition.

According to the third aspect of the present invention in which the magnetic pattern of the development zone is designed on the basis of the concept of "magnetic attraction force", the developer attached to the spikes erecting from the developing magnetic pole toward the photoconductor surface can readily be released or separated from the spike tips, and the delivery of the developer from the spike tips to the photoconductor can be attained effectively. Therefore, a satisfactory quality/density can be secured. Since the spike tips are loose or soft and the contact pressure of the spike tips with the photoconductor surface is low, the spike tips never scrape off the developer delivered onto the photoconductor surface, whereby a developed image of high quality can be produced which is free of image faults such as scavenging. Since the spike tips are prevented from damaging the photoconductor surface, the photoconductor is prevented from wearing.

Where the force of attracting the developer toward the sleeve is made to act on the downstream side of the spot in which the magnetic repulsion force is caused by the developing magnetic pole, even when the developer is excessively attached to the photoconductor surface, it can be adequately collected on the side of the developing cylinder; therefore, the background fog phenomenon (called toner background fog or carrier background fog and caused by excessive attaching of the developer) can also be prevented.

What is claimed is:

1. A developing device comprising a developing cylinder in confronting relation to a photoconductor of an electrophotographic developing machine, the developing cylinder comprising a cylindrical sleeve rotatably supported around a magnet roll in noncontact condition, the magnet roll having a plurality of magnetic poles provided on the periphery thereof, characterized in that among said magnetic poles, one of weak magnetic flux density is provided which functions to separate a developer from the sleeve surface and is made identical on its surface in polarity with magnetic poles of strong magnetic flux density provided adjacent to said weak magnetic pole on the upstream side and downstream side in the travel direction of the developer, and that a magnetic working force caused by said magnetic pole of weak magnetic flux density functions to separate a developer from the sleeve surface and is designed on the basis of a magnetic attraction force which results from a vector composite force consisting of a radial magnetic flux density and a tangential magnetic flux density on the sleeve surface and controls the behavior of the developer such that a magnetic working force on the sleeve surface of the magnetic pole of weak magnetic flux density which functions to separate a developer from the sleeve surface is a force which pulls the developer disposed on the sleeve surface outward off the sleeve due to the radial magnetic flux density being stronger at the point spaced slightly from the sleeve surface in the radial direction than at the sleeve surface;

wherein said magnetic pole of weak magnetic flux density is provided in a development zone in which the developer is delivered from the sleeve surface to the photoconductor, the magnetic working force acting on a given area inclusive of a spot proximate to the photoconductor is made to act as the magnetic repulsion force functioning to separate the developer from the sleeve surface; and wherein in a distribution of radial magnetic flux density caused by the magnetic pole of weak magnetic flux density in the development zone, the minimal value of the magnetic flux density of the magnetic pole of weak magnetic flux density proximate to the photoconductor in the development zone is set smaller than the maximal value of the magnetic force of the magnetic pole of strong magnetic flux density provided adjacent to the magnetic pole of weak magnetic flux density on the upstream side in the travel direction of the developer by at least 20% of the maximal value.

2. A developing cylinder according to claim 1, wherein the magnetic working force acting on the downstream side in the travel direction of the developer in adjacent relation to the spot giving the magnetic repulsion force in the development zone is made to act as the magnetic attraction force functioning to attract the developer toward the sleeve.

3. A developing method comprising:

providing a developing cylinder in confronting relation to a photoconductor of an electrophotographic developing machine, the developing cylinder having a cylindrical sleeve and a magnet roll;

rotating the cylindrical sleeve around the magnet roll in a noncontact condition, the magnet roll being fixedly secured and having a plurality of magnetic poles provided on the periphery thereof;

when during the rotation of said cylindrical sleeve, the cylindrical sleeve collects developer from a developer source and deposits developer onto the photoconductor;

wherein in depositing developer on the photoconductor a magnetic working force on the sleeve surface causes developer to separate from the sleeve surface in the direction from the sleeve surface toward the photoconductor due to the radial magnetic flux density being stronger at the point spaced slightly from the sleeve surface in the radial direction than at the sleeve surface;

wherein among the plurality of magnetic poles provided on the periphery of the magnet roll disposed within the rotating cylindrical sleeve, one magnetic pole is of weak magnetic flux density and is provided for separating the developer from the sleeve surface, the magnetic pole of weak magnetic flux density having a polarity identical on its surface to magnetic poles of strong magnetic flux density provided adjacent to the weak magnetic pole on the upstream side and downstream side in the travel direction of the developer;

wherein said magnetic working force causing the separation of developer from the sleeve surface is designed on the basis of a magnetic attraction force which results from a vector composite force consisting of a radial magnetic flux density and a tangential magnetic flux density on the sleeve surface such that said magnetic working force on the sleeve surface of the magnetic pole of weak magnetic flux density functions to separate developer from the sleeve surface due to a force which pulls the developer disposed on the sleeve surface outward off the sleeve toward the photoconductor;

wherein said magnetic pole of weak magnetic flux density is provided in a development zone in which the developer is delivered from the sleeve surface to the photoconductor, the magnetic working force acting on a given area inclusive of a spot proximate to the photoconductor is made to act as the magnetic repulsion force functioning to separate the developer from the sleeve surface; and wherein in a distribution of radial magnetic flux density caused by the magnetic pole of weak magnetic flux density in the development zone, the minimal value of the magnetic flux density of the magnetic pole of weak magnetic flux density proximate to the photoconductor in the development zone is set smaller than the maximal value of the magnetic force of the magnetic pole of strong magnetic flux density provided adjacent to the magnetic pole of weak magnetic flux density on the upstream side in the travel direction of the developer by at least 20% of the maximal value.

* * * * *

UNITED STATES PATENT AND TRADEMARK OFFICE

CERTIFICATE OF CORRECTION

PATENT NO. : 5,434,351

DATED : July 18, 1995

INVENTOR(S) : Iwai et al

It is certified that error appears in the above-indentified patent and that said Letters Patent is hereby corrected as shown below:

On the title page: Item [30], the first line , the priority date "Sep.9, 1991" should read --Sep.11, 1991 --.

Signed and Sealed this

Twenty-fourth Day of October, 1995

*Attest:*

Bruce Lehman

BRUCE LEHMAN

*Attesting Officer*

*Commissioner of Patents and Trademarks*